US005934954A

United States Patent [19]

Schott et al.

[11] Patent Number: 5,934,954

[45] Date of Patent: Aug. 10, 1999

[54] BRAKING SYSTEM FOR A WATERCRAFT

[75] Inventors: Carl G. Schott, Fond du Lac; James R. Jones, Neosho; Peter P. Grinwald, Rubicon; Rick P. Christians, Appleton, all of Wis.

[73] Assignee: Brunswick Corporation, Lake Forest, Ill.

[21] Appl. No.: 09/008,372

[22] Filed: Jan. 16, 1998

[51] Int. Cl.[6] ..... B63H 11/11

[52] U.S. Cl. ..... 440/41; 440/42

[58] Field of Search ..... 440/41, 40, 42; 114/170, 145 R

[56] References Cited

U.S. PATENT DOCUMENTS

| | | | |
|---|---|---|---|
| 3,782,320 | 1/1974 | Groves, Jr. | 440/41 |
| 3,937,172 | 2/1976 | Castoldi | 115/12 R |
| 5,092,260 | 3/1992 | Mardikian | 114/285 |
| 5,193,478 | 3/1993 | Mardikian | 114/286 |
| 5,299,960 | 4/1994 | Day et al. | 440/39 |
| 5,344,344 | 9/1994 | Forsstrom | 440/41 |
| 5,474,007 | 12/1995 | Kobayashi et al. | 440/42 |
| 5,551,898 | 9/1996 | Matsumoto | 440/41 |
| 5,607,332 | 3/1997 | Kobayashi et al. | 440/41 |
| 5,622,132 | 4/1997 | Mardikian | 114/144 R |
| 5,713,770 | 2/1998 | Ambli | 440/42 |

OTHER PUBLICATIONS

United States patent application serial No. 08/783,440 (M09082) which was filed by Jones on Jan. 16, 1997.

*Primary Examiner*—Sherman Basinger
*Attorney, Agent, or Firm*—William D. Lanyi

[57] ABSTRACT

A control mechanism is provided for a jet propelled watercraft that enables an operator to engage and disengage a braking gate with hand pressure using a lever on the handlebar of the watercraft. Hydrodynamic assist devices are provided to assist the operator during the engagement and disengagement of the brake by counteracting both rejecting forces and retaining forces exerted on the gate by the stream of water ejected from the nozzle of the jet propulsion device. During initial insertion of the gate into the stream of water, a first hydrodynamic assist device counteracts the rejection forces otherwise exerted by the stream of water against a deflecting surface of the gate. After full deployment of the gate within the stream of water, a second hydrodynamic assist device opposes the retaining forces exerted on the gate and reduce the magnitude of the force necessary to be exerted by the operator to move the gate out of the stream of water and disengage the brake. Combinations of the two hydrodynamic assist devices can be tailored to result in an appropriate force profile necessary to be exerted by the operator during the engagement and disengagement procedures.

16 Claims, 9 Drawing Sheets

BRAKING SYSTEM FOR A WATERCRAFT

BACKGROUND OF THE INVENTION

1. Field of the Invention

The present invention is generally related to a watercraft braking system and, more particularly, to a control mechanism for a jet propelled watercraft that provides a hydrodynamic assist device which facilitates either the engagement of the brake or the disengagement of the brake, or both, when the brake is actuated by an operator of the watercraft.

2. Description of the Prior Art

Jet propelled watercraft have been used for many years, and many types of jet propelled watercrafts are well-known to those skilled in the art. It is also well-known to provide a reverse gate, which is sometimes referred to as a reverse bucket, for the purpose of allowing the watercraft to move in a reverse direction. In certain circumstances, the reverse gate can be used to perform a braking function to slow and stop the watercraft, but the use of a reverse gate for the purpose of braking a watercraft is not generally advised with many known systems because of several disadvantages that exist in known reverse gate systems.

U.S. Pat. No. 5,551,898, which issued to Matsumoto on Sep. 3, 1996, discloses a discharge nozzle arrangement for a waterjet propulsion unit. Several embodiments of the device are described in relation to the steering nozzle and reverse thrust bucket for the jet propelled watercraft. The steering nozzle, in addition to being mounted for steering movement about a vertically extending steering axis, is also mounted for trim adjustment about a horizontally extending axis. A cooperating reverse thrust bucket provides reverse thrust operation. The reverse thrust bucket is either mounted on the hull of the watercraft independently of the jet propulsion unit, on the outer housing of the jet propulsion unit independently of the steering nozzle, or on the steering nozzle.

U.S. Pat. No. 5,344,344, which issued to Forsstrom on Sep. 6, 1994, describes a steering and reversing system for a marine jet propulsion unit. The system has a stationary nozzle for discharging a waterjet rearwardly from the unit and comprises a pair of steering and reversing members that are mounted side by side at the rear end of the nozzle and individually pivotable in opposite directions about upright axes from a non-deflecting position to first and second deflecting positions. In the non-deflecting position, the steering and reversing members form a rearwardly directed extension of the nozzle, while in the first deflecting position each member diverts a portion of the waterjet laterally outwardly by means of its front section. In the second deflecting position each member deflects a portion of the waterjet downwardly and forwardly by means of scoop-like members at its rear section.

U.S. Pat. No. 3,937,172, which issued to Castoldi on Feb. 10, 1976, discloses a waterjet propelling apparatus for boats. The apparatus forces water by a pump through a nozzle directed a stern of a boat. A curved jet-deflecting surface downwardly and forwardly deflects the water and reverses the thrust, and a pair of steerable parallel rudder blades are pivotable in unison for laterally deviating the jet. The jet-deflecting surface has symmetrical channel-like side portions which direct water escaping laterally from the clearance between the trailing edges of the rudder blades and the jet-deflecting surface forwardly towards the bow to enhance the reverse thrust, and a central portion which is shaped with blades for maintaining the clearance with the later constant for various pivotal deviations of the blades.

U.S. Pat. No. 5,622,132, which issued to Mardikian on Apr. 22, 1997, describes a shock absorbing steering system for a personal watercraft. The improved steering assembly for a personal watercraft governs the positioning of a steering nozzle through a cable that is affixed to a steering shaft attached to handlebars gripped by the operator of the watercraft. The steering shaft is mounted to the hull in a retainer member relative to which it is rotatable. The handlebars are shielded from the shocks and bumps occurring while the watercraft travels on rough water by a shock absorber that is mounted between the retainer member and the handlebars. The improved steering assembly significantly increases riding comfort and reduces operator fatigue.

U.S. Pat. No. 5,193,478, which issued to Mardikian on Mar. 16, 1993, describes a system for trimming, steering and braking a watercraft which includes a retractable plate or flap disposed on each lateral side of the hull of the watercraft. Each flap is extendible into the water, rearwardly in a continuously adjustable manner, and independently of the extension of the other flap. When the flap is fully extended, its angular position relative to the hull is also continuously adjustable independently of the angular positioning of the other flap. The flaps in their fully declined position act as powerful brakes for the watercraft. The differential extension of the flaps or differential adjustment of the relative angular positions on the two sides of the watercraft results in trimming and steering of the watercraft.

U.S. Pat. No. 5,092,260, which issued to Mardikian on Mar. 3, 1992, discloses a personal watercraft with brakes. The watercraft such as a jet ski is equipped with a hull, engine, propulsion and ride plate assembly which is attached to the bottom section of the hull. The ride plate assembly includes a fixed plate and a lower plate or flap hingedly mounted to the fixed plate to occupy continuously adjustable varying angular positions relative to the fixed plate. A manually operated control mechanism, controlled by an operator, adjusts the angular positioning of the flap within a pre-determined range. It is an important characteristic of the continuously adjustable flap that, within the range in which its angular positioning relative to the fixed plate and of the water can be changed, an initial and moderate change in angular positioning results in more hydrodynamic lift to act on the watercraft and therefore an increased speed of the watercraft. However, beyond a certain value, further deflection of the flap results in significant braking action. In another embodiment of the watercraft, braking of the watercraft is accomplished by mechanically braking the shaft which connects the engine with the propulsion system. This is accomplished by placing mechanically or hydraulically actuated brake pads in operative engagement with a rotating shaft or with a rotating disc fixedly mounted to the shaft. The brakes slow down the rotation of the propulsion system and therefore the entire craft, significantly faster than mere release of the throttle, as is done in the prior art.

U.S. Pat. No. 5,607,332, which issued to Kobayashi et. al. on Mar. 4, 1997, discloses a control system for a jet powered watercraft. A number of embodiments of jet propelled watercraft have an improved pedal operated reverse thrust bucket mechanism. The pedal for operating the reverse thrust bucket is positioned so that it is generally flush with the floor area when the reverse bucket is in its forward drive mode and can be depressed into a recessed area of the floor area for effecting trim or reverse thrust operation of the reverse thrust bucket. In this way, the pedal does not obscure the rider's foot area but is still readily accessible for the rider.

U.S. Pat. No. 5,551,898, which issued to Matsumoto on Sep. 3, 1996, describes a discharge nozzle arrangement for a waterjet propulsion unit. A number of embodiments of the steering nozzle and reverse thrust bucket arrangements for jet propelled watercraft are described. The steering nozzle, in addition to being mounted for steering movement about a vertically extending steering axis, is also mounted for trim adjustment about a horizontally extending axis. A cooperating reverse thrust bucket provides reverse thrust operation. The reverse thrust bucket is either mounted on the hull of the watercraft independently of the jet propulsion unit, on the outer housing of the jet propulsion unit independently of the steering nozzle, or on the steering nozzle.

U.S. Pat. No. 5,299,960, which issued to Day et. al. on Apr. 5, 1994, describes an auxiliary water projector for a jet propelled watercraft. The projector system only requires removal of the steering nozzle in order to be connected to the waterjet propulsion system. A thrust control valve is positioned adjacent to the remounted steering nozzle. Using the thrust control and a flow control valve, the operation of the watercraft and auxiliary water projector can be simultaneously controlled to include stationary, forward or reverse movement of the watercraft.

U.S. Pat. No. 5,752,864, which was filed by Jones on Jan. 16, 1997 and assigned to the assignee of the present invention, discloses a reverse gate for a personal watercraft. The reverse mechanism includes a reverse gate that provides low restriction to the flow of water through the jet pump and also provides significant steering characteristics. The reverse gate has a deflector surface with a vertical jet divide that divides the deflector surface. Both sides of the deflector surface are in the form of a simple curve. In the preferred embodiment, the simple curve deflector surfaces slant inward towards a central apex which serves as the vertical jet divide. The deflector surface spans between a starboard side support structure and a port side support structure which are pivotally mounted along a horizontal axis so that the reverse gate can be moved between a full-up position and a full-down position rearward of the jet pump. Both the starboard side support structure and the port side support structure include apertures therethrough which allow a portion of the jet flow to exit laterally from the reverse gate. When the reverse gate is in the fully down position, a portion of the jet flow is redirected forward to provide reverse thrusts. A portion of the jet of water is deflected laterally to port and laterally to starboard proportionally in accordance with the direction of the jet pump rudder.

U.S. Pat. No. 5,755,601 which was filed by Jones on Mar. 17, 1997 and assigned to the assignee of the present invention, discloses a brake system for a personal watercraft. The watercraft has a brake which the driver of the watercraft can use to decelerate the forward motion of the watercraft. The brake mechanism preferably includes a reverse gate that allows steering to be consistent when the watercraft is accelerating or cruising with the reverse gate in a full-up position as when the watercraft is decelerating with the reverse gate in a full-down or partial-down position. The positioning of the reverse gate during operation of the watercraft is adjusted in accordance with the state of hand operated actuators for a forward throttle control mechanism and a brake control mechanism. Preferably, an electronic controller receives a signal from the control mechanisms and outputs a control signal that directs a servo motor to move a reverse gate control cable or linkage to position the reverse gate. Forward thrust can be increased by proportionally closing the actuator for the forward thrust control mechanism. In addition, reverse thrust or braking thrust can be increased by proportionally closing the actuator for the brake control mechanism.

Many types of reverse gate mechanisms can possibly be used as a brake to slow the speed of a watercraft, but for various reasons this is not always easily accomplished. For example, in watercraft that use a lever mounted on the side of the hull to actuate the reverse gate, the operator must release his or her grip on the handlebars in order to reach down to the reverse gate lever. In addition, because of the magnitude of the hydrodynamic forces involved in the movement of a reverse gate into the outlet stream of water being ejected by the jet pump, it is typically necessary to provide an actuating lever with a sufficiently long arm to allow the operator to have sufficient leverage to more easily overcome the forces which tend to resist the actuation of the brake when the engine of the watercraft is operating at a significant speed.

Another reason why reverse gates are not intended for use as brakes for personal watercraft is that most reverse gates are not sufficiently robust to withstand the rigors of use in this manner. The forces created by the stream of water flowing out of a jet pump nozzle can damage the reverse gate if it is repeatedly operated while the engine of the watercraft is operating at full power. Although certain reverse gates may be sufficiently rugged to withstand this type of use, it still requires a significant physical effort to engage the brake while the watercraft is operating at a relatively high speed. It also requires a significant operator effort to disengage the brake when the engine is operating at a relatively high speed.

It is clearly desirable to provide a hand operated brake which does not require the watercraft operator to release the grip on the handlebars for the purpose of actuating the brake. For example, it would be highly desirable to provide a brake actuation lever similar to the types of brake levers used on motorcycle handlebars. This would allow the operator to actuate the brake by merely extending the fingers over the lever and squeezing the lever to move it relative to the handlebars. In this way, the mere tightening of the operator's grip is sufficient to actuate the brake. However, as will be described in greater detail below, the hydrodynamic forces created by the ejected stream of water from the jet pump as the water impacts the deflecting surface of the gate can be sufficiently high to prohibit the effective and quick operation of the brakes through the use of the operator's fingers alone. It would therefore be significantly beneficial if a control mechanism could be provided for a jet propelled watercraft that allows an operator to actuate the brake with only the force of his or her hand gripping the handlebars, but would also allow the brake to be disengaged with an approximately or equal amount of hand force.

SUMMARY OF THE INVENTION

A control mechanism for a jet propelled watercraft, made in accordance with the preferred embodiment of the present invention, comprises a nozzle attached to the watercraft. The nozzle conducts a stream of water rearwardly from the watercraft to propel the watercraft. A gate is rotatably attached to the watercraft and moveable about a pivot point through a range of positions from a first position, which is essentially out of the stream of water, to a second position, which is essentially completely within the stream of water, in order to provide a braking effect on the watercraft. The control mechanism of the present invention further comprises a first hydrodynamic assist device which is moveable with the gate. The first hydrodynamic assist device provides a first force which results in a first moment about the pivot point of the gate for the purpose of urging the gate in a first direction.

The first direction described immediately above can be toward the second position of the gate in order to assist in providing the braking effect on the watercraft or, alternatively, it can be toward the first position which is essentially out of the stream of water in order to assist in removing the braking effect on the watercraft. In addition, both of these effects can be achieved if both a first hydrodynamic assist device and a second hydrodynamic assist device are provided on the same gate.

Either the first or second hydrodynamic assistance device can comprise a surface which, when moved into the stream of water, creates the first force which urges the gate toward the second position which is completely within the stream of water. Alternatively, the hydrodynamic assist device can comprise a raised ridge which, when moved into the stream of water, creates a force which urges the gate back towards the first position.

In one instance where the force urges the gate in a direction from the first position to the second position, it assists an operator in engaging the brake by reducing the force required to push the gate into the stream of water. In the second instance, where the force is in a direction from the second position to the first position, it creates a force which assists the operator or the brake operation mechanism in overcoming the force exerted by the stream of water which tends to retain the gate in its second position within the stream of water. The provision of these two assisting forces allows a brake mechanism to be developed which requires only a handle grip that can be actuated with one hand of the operator by squeezing a lever with the operator's fingers while maintaining hand contact with the handlebar of the watercraft. As a result of the concepts of the present invention, the brake system of a watercraft can be operated in a manner that is very similar to the manner in which a motorcycle rider operates the brakes of the motorcycle even though the watercraft brake experiences a much higher force that resists the actuation of the brake system and, furthermore, even though a watercraft brake experiences a much higher retention force that tends to resist the disengagement of the brake.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
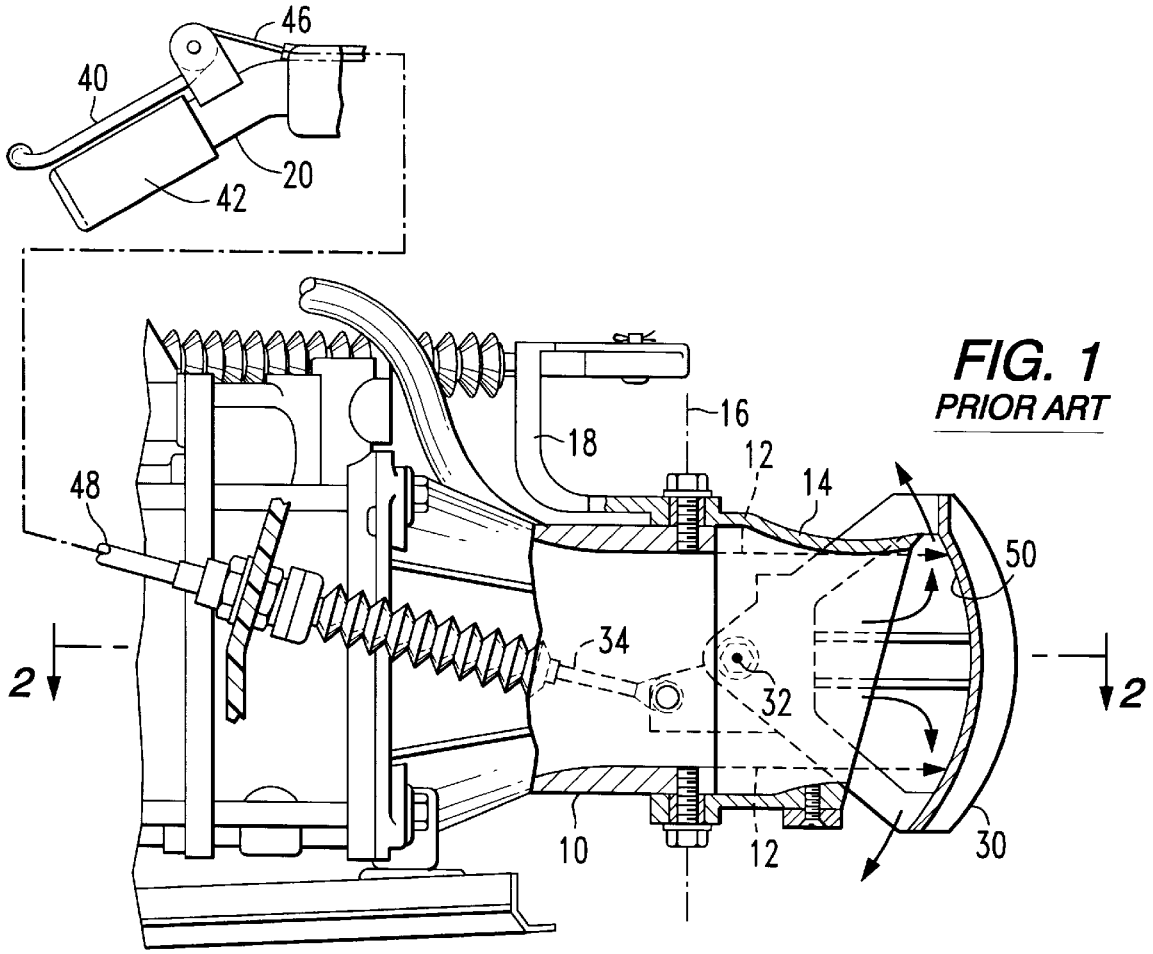
FIG. 1 PRIOR ART
FIGS. 1 and 2 show the components of a known reversing gate and nozzle of a jet propulsion device.

Throughout the description of the preferred embodiment of the present invention, like components will be identified by like reference numerals.

Figure 2:
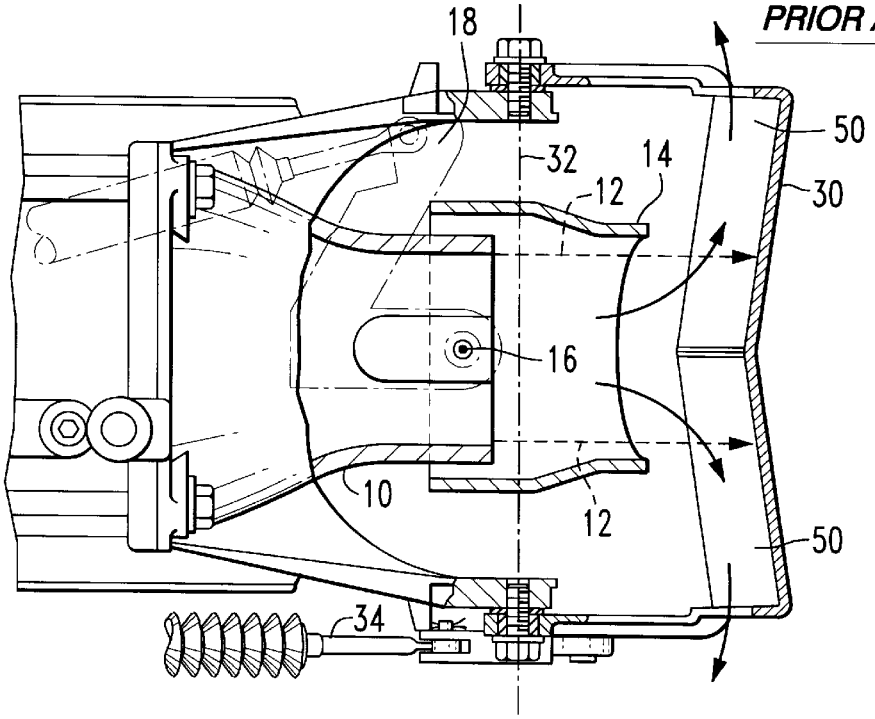
FIG. 2 PRIOR ART

FIGS. 1 and 2 show two views of a brake mechanism that is described in more significant detail in U.S. Pat. No. 5,752,864 and U.S. Pat. No. 5,755,601.

FIG. 1 shows a nozzle 10 of a jet propulsion system for a watercraft. A stream of water flows out of the nozzle 10 within the region defined by dashed lines 12 in FIG. 1. A rudder 14 is pivotable about a vertical axis 16 in response to movement of an actuator 18 that is controlled by an operator of the watercraft with movements of the handlebars 20. The rotation of the rudder 14 about axis 16 controls the direction of the stream of water flowing out of the rudder 14 and thereby imparts a force vector on the watercraft in a desired direction as determined by the operator's movement of the handlebars 20. Also shown in FIG. 1 is a reverse gate 30 that is pivotable about a horizontal axis 32 in response to an actuator mechanism 34 that is controllable by the operator. A lever 40 is provided on the handlebar 20 near a handgrip 42. The actuator 34 is moved by a cable 46 within tube 48 to cause the gate 30 to rotate about its axis 32. It should be understood that the lever 40 can cause the gate 30 to move through a range of positions from a first position, completely out of the stream of water between dashed lines 12 and held vertical above its axis 32, to a second position, illustrated in FIG. 1 with the gate 30 completely within the stream of water.

With continued reference to FIG. 1, it can be seen that when the gate 30 is in the second position, within the stream of water 12, the water impacts against a deflecting surface 50 and is diverted both upwardly and downwardly as represented by the arrows in FIG. 1. The diverted stream of water is no longer directed in a rearwardly direction but, instead, is deflected in a forward direction creating a resultant force vector that causes the watercraft to move in a reverse direction. Naturally, if the gate 30 is engaged into the second position shown in FIG. 1 while the watercraft is moving forward, it will exert a braking effect on the watercraft.

FIG. 2 is a section view taken through the device illustrated in FIG. 1. It should be understood that FIG. 1 is a partially sectioned side view of the components of a jet propulsion system while FIG. 2 is a top section view of FIG. 1 and of the components of the jet propulsion system when in its normal configuration of use. The rudder 14 is moveable by actuator 18 in a clockwise or counterclockwise direction about its vertical axis 16 in order to effect appropriate steering of the watercraft. The gate 30 is rotatable about its horizontal axis 32 to move the gate completely out of the stream of water 12 at its first position or into an engaged position within the stream of water 12 to engage the brake. FIGS. 1 and 2 illustrate the basic components of a braking mechanism for a jet propulsion system which are generally known to those skilled in the art or described in previously filed patent applications.

FIGS. 3A–3D are highly schematic representations of a gate 30 shown in various positions relative to its axis of rotation 32 and relative to the flow of a stream of water 12.

The schematic representations of FIGS. 3A–3D are intended to describe and illustrate the types of problems encountered in known jet propulsion systems when the gate 30 is used as a brake.

Figure 3A:
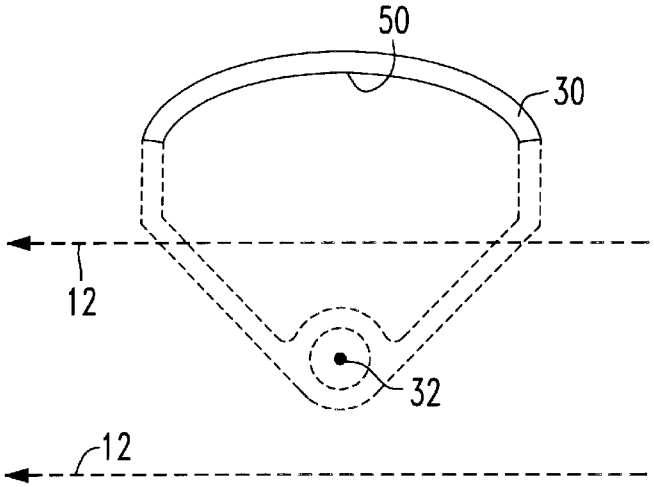
FIGS. 3A–3D are highly schematic representations of a gate at various positions of movement between its extreme limits of travel.

FIG. 3A shows the gate 30 in its first position disposed vertically above its axis of rotation 32 and generally out of the stream of water 12. As described above, it should be understood that dashed lines 12 are intended to represent the general location of the stream of water ejected by the nozzle 10 of a jet propulsion system as described above in conjunction with FIGS. 1 and 2. With the deflecting surface 50 of the gate 30 completely out of the stream of water 12, essentially no force is exerted on the gate 30 by the stream of water. The position shown in FIG. 3A is that which would be the normal position of the gate 30 when the watercraft is operated in a forward direction with no attempt being made to engage the brake. In this description, the position shown in FIG. 3A is described as the first position of the gate 30.

Figure 3B:
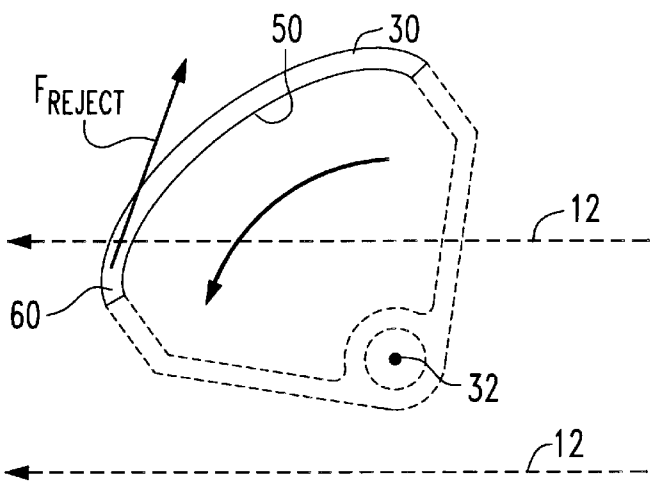

FIG. 3B shows the gate 30 as it is being rotated slightly about its axis 32 in a counterclockwise direction. One edge 60 of the gate 30 is within the stream of water 12 as the gate 30 is moved away from its first position shown in FIG. 3A. The stream of water 12 exerts a force against the deflecting surface 50 which creates a moment about axis 32 in a clockwise direction. The resulting force on the gate 30 is identified by arrow $F_{REJECT}$. This rejecting force resists an operator's effort to move the gate 30 further into the stream of water 12 in order to engage the brake. The rejecting force $F_{REJECT}$ must be overcome if the gate 30 is to be engaged as a brake. This rejecting force $F_{REJECT}$ will be described quantitatively below in greater detail.

Figure 3C:
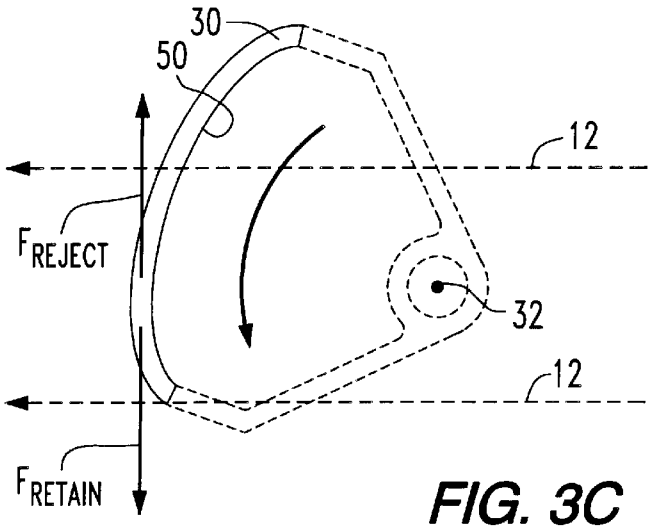

FIG. 3C shows the gate 30 after it has been rotated further into the stream of water 12. At some point between the first position shown in FIG. 3A and the second position shown in FIG. 3D, the gate 30 reaches a magnitude of rotation about its axis 32 at which the rejecting force $F_{REJECT}$ is generally balanced by a retaining force $F_{RETAIN}$ which increases as the gate 30 rotates in a counterclockwise direction further into the stream of water 12. Eventually, the retaining force $F_{RETAIN}$ will balance the rejecting force $F_{REJECT}$, and the forces experienced by the operator when trying to engage the brake will achieve a resultant force which is at a minimum magnitude.

Figure 3D:
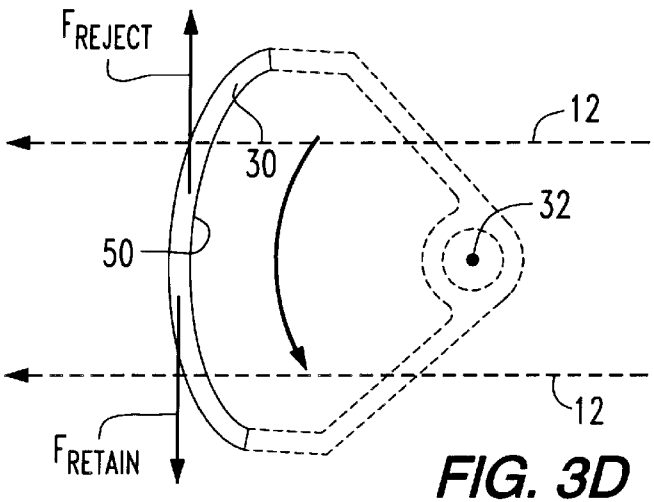

FIG. 3D shows the gate 30 in its second position which is fully into the stream of water 12. At this point, the rejecting force $F_{REJECT}$ is at its minimum and the retaining force $F_{RETAIN}$ is near its maximum. As a result, the gate 30 will typically be retained in the second position shown in FIG. 3D even if no force on the braking system is exerted by the operator. The stream of water 12 is typically sufficient to hold the gate 30 in the second position and resist an operator's attempt to disengage the brake by removing the brake 30 from the stream of water 12. As a result, braking systems typically require some sort of return spring to be provided to assist the operator in moving the gate 30 from the second position shown in FIG. 3D to the first position shown in FIG. 3A. The purpose of this return spring would be to overcome the net retaining force $F_{RETAIN}$ exerted by the stream of water 12 after the gate 30 is fully engaged in its second position. However, if a return spring is used for these purposes, the force of that return spring must then be overcome when the operator initially moves the gate 30 from its first position shown in FIG. 3A toward its second position shown in FIG. 3B.

As described immediately above, it can be seen that two disadvantageous forces occur which are both deleterious for braking systems. The rejecting force $F_{REJECT}$ resists the operator's attempt to initially engage the brake by moving the gate from the first position shown in FIG. 3A toward the second position shown in FIG. 3D. This resistance to the operator's actuation of the brake mechanism can further be exacerbated if a return spring is provided to assist the operator in overcoming the retaining force $F_{RETAIN}$ that is exerted when the gate is in its second position as shown in FIG. 3D.

As described above, the other disadvantageous force exerted by the stream of water 12 is the retaining force $F_{RETAIN}$ that tends to hold the gate 30 within the stream of water when the operator attempts to rotate it out of the stream of water to disengage the brake. Both of these forces are disadvantageous and must be overcome in order to provide an effective and efficient braking system for a jet propelled watercraft.

Figure 4:
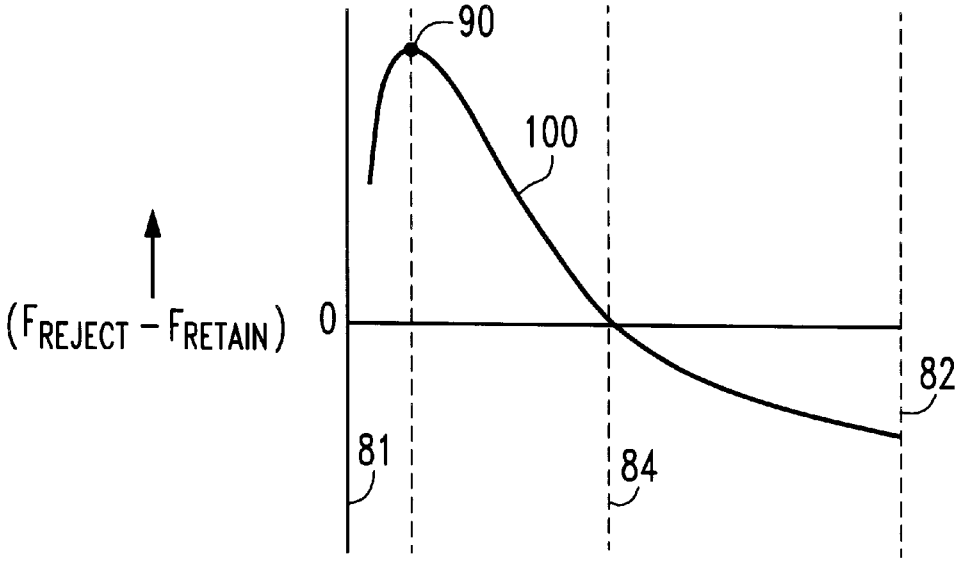
FIG. 4 shows a force profile of a typical gate as it moves between a first position and a second position.

FIG. 4 is a graphical representation of the net force profile on the gate 30 as it moves from the first position 81, which is coincident with the vertical axis in FIG. 4, to the second position 82 represented by a dashed line in FIG. 4. Dashed line 84 in FIG. 4 represents a middle position of the gate 30, such as that represented in FIG. 3C described above. The first position 81 of the gate 30 is shown in FIG. 3A, and the second position 82 of the gate 30 is shown in FIG. 3D. Although it should be understood that rejecting force $F_{REJECT}$ and retaining force $F_{RETAIN}$ act on the gate 30 throughout its total range of travel between the first and second positions, the net resultant force or combination of the rejecting forces and retaining forces is represented in FIG. 4. As the gate 30 moves from the first position 81 to the second position 82, it experiences a maximum net rejecting force at point 90 as the leading edge 60 of the gate 30 begins to enter the stream of water 12. Although this net rejecting force subsides with continued rotation of the gate into the stream of water 12, it is still significant for most of the travel from the first position 81 to the neutral position 84 as illustrated in FIG. 3C. During this time, the force of the stream of water 12 against the deflecting surface 50 resists the operator's attempt to actuate the brake and force the gate 30 into the stream of water. This rejecting force must be overcome in order to engage the brake by moving the gate 30 into its second position 82 as shown in FIG. 3D.

With continued reference to FIG. 4, it can be seen that, as the gate 30 moves from the neutral position 84 to the second position 82, it experiences a net assisting force because of the increase of the retaining force $F_{RETAIN}$ . This force, because it is illustrated as a negative value in FIG. 4, tends to pull the gate 30 in a counterclockwise direction as it moves from the position shown in FIG. 3C to the second position shown in FIG. 3D. Once in the second position 82, the gate 30 is retained in that position by the continued flow of the stream of water 12. If the operator wishes to disengage the brake, a sufficient force must be provided to overcome the net retaining force exerted on the gate 30 when the gate is in the second position 82 as illustrated in FIG. 3D.

As discussed above, a return spring can possibly be used to assist the operator in forcing the gate 30 out of the stream of water 12 after the brake has been engaged. This spring force would counteract the negative magnitudes of the net force represented between the neutral position 84 and the second position 82 in FIG. 4. However, this same return spring would exert a force on the gate 30 at all times and would, in essence, raise all of the magnitudes of the line 100 in FIG. 4. This would make the rejecting force at point 90 even higher than it is shown.

Figure 5:
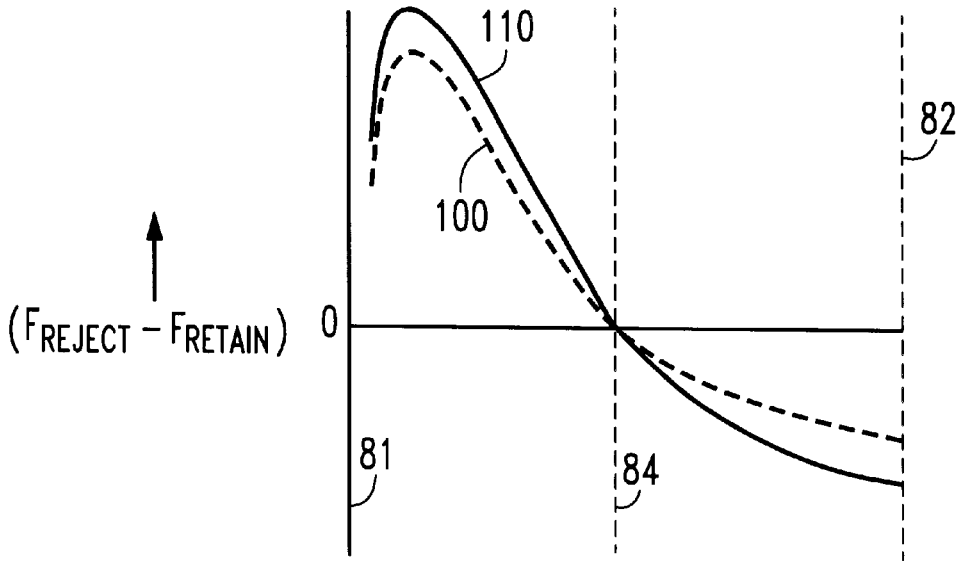
FIG. 5 shows the profile of FIG. 4 in combination with another profile resulting from an increase in engine speed.

FIG. 5 shows two lines, 100 and 110, which represent the net force on the gate 30 for two different engine speeds as it moves from the first position 81 to the second position 82. Line 100, described above in conjunction with FIG. 4, represents a first engine speed, and line 110 represents a higher engine speed which would result in a higher water velocity within the stream of water 12 being ejected from the nozzle 10 as shown in FIGS. 1 and 2. This increase in engine speed exacerbates both conditions. In other words, it raises the rejecting force $F_{REJECT}$ between the first position 81 and the neutral position 84. It also increase the retaining force $F_{RETAIN}$ between the neutral position 84 and the second position 82. Therefore, the problems described above in conjunction with FIG. 4 are made even worse with increased engine speed and the resulting increased velocity of water-flow through the jet propulsion system. It would therefore be beneficial if a means could be provided to alleviate the problems represented by the rejecting force and retaining force discussed above in conjunction with FIGS. 4 and 5.

Figure 6:
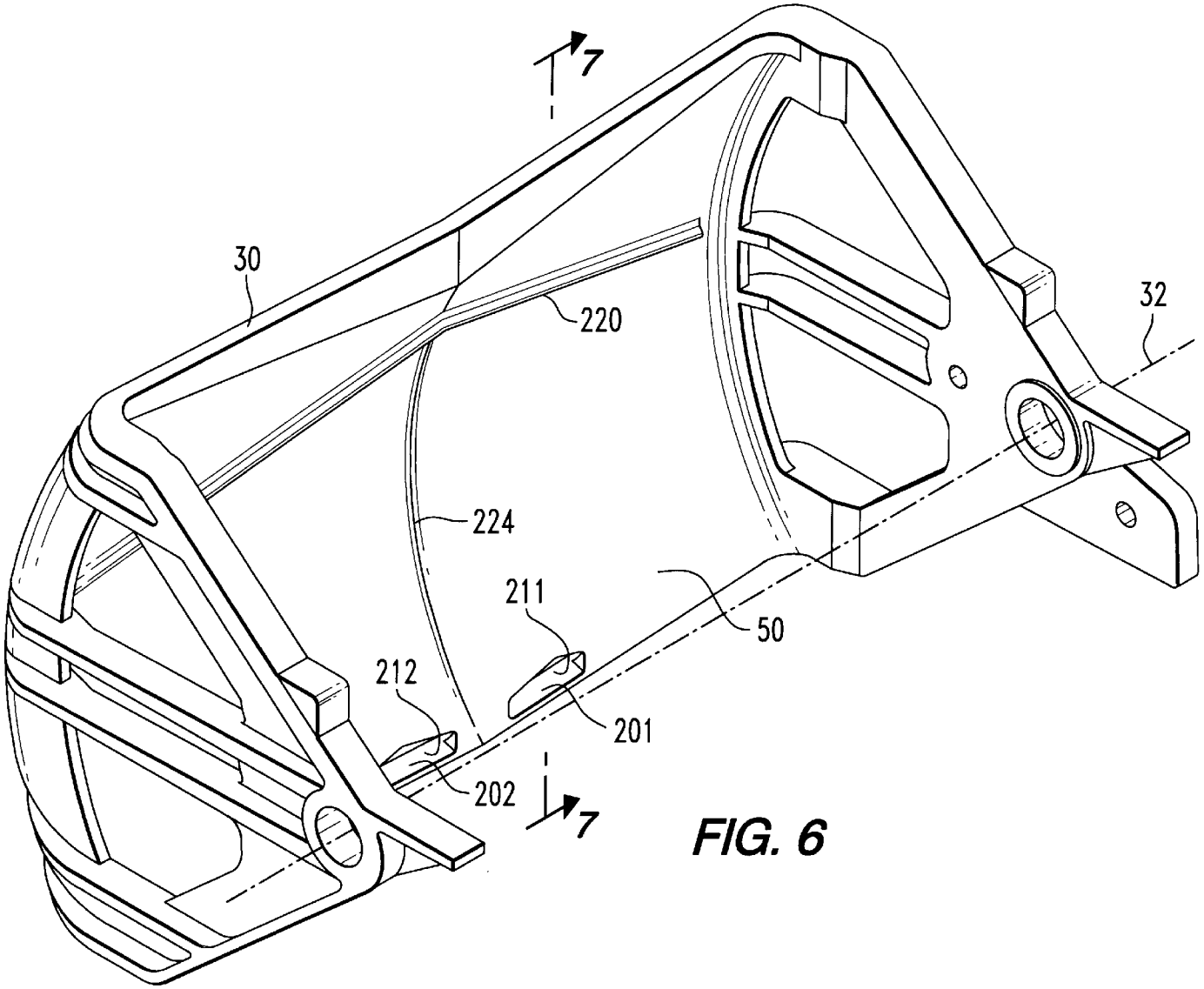
FIG. 6 is a perspective view of a gate made in accordance with the present invention.

FIG. 6 is a perspective view of a gate 30 made in accordance with the present invention. The side support structures connect the water deflecting surface 50 of the gate 30 to the pivots which allow the gate to rotate about its axis of rotation 32. Two hydrodynamic assist devices are provided in the embodiment of the present invention shown in FIG. 6. A first hydrodynamic assist device comprises the two surfaces, 201 and 202, formed within the openings, 211 and 212, respectively. As will be described in greater detail below, the stream of water 12 flows through the openings, 211 and 212, and exerts a force against the surfaces, 201 and 202. These surfaces act in a manner analogous to air foils and allow the stream of water 12 to exert a force on the gate 30 which is in an opposite direction to the rejecting force $F_{REJECT}$ described above. As a result, the first hydrodynamic assist device which comprises the surfaces, 201 and 202, help the operator of the watercraft to move the gate 30 into the stream of water 12 by providing an opposing force that reduces the result of the rejecting force $F_{REJECT}$ exerted by the stream of water.

Also shown in FIG. 6 is a second hydrodynamic assist device which comprises a raised ridge 220 disposed on the deflecting surface 50 of the gate 30. the raised ridge is V-shaped or chevron-shaped and is generally symmetrical about a flow dividing ridge 224 formed on the deflecting surface 50.

Figure 7:
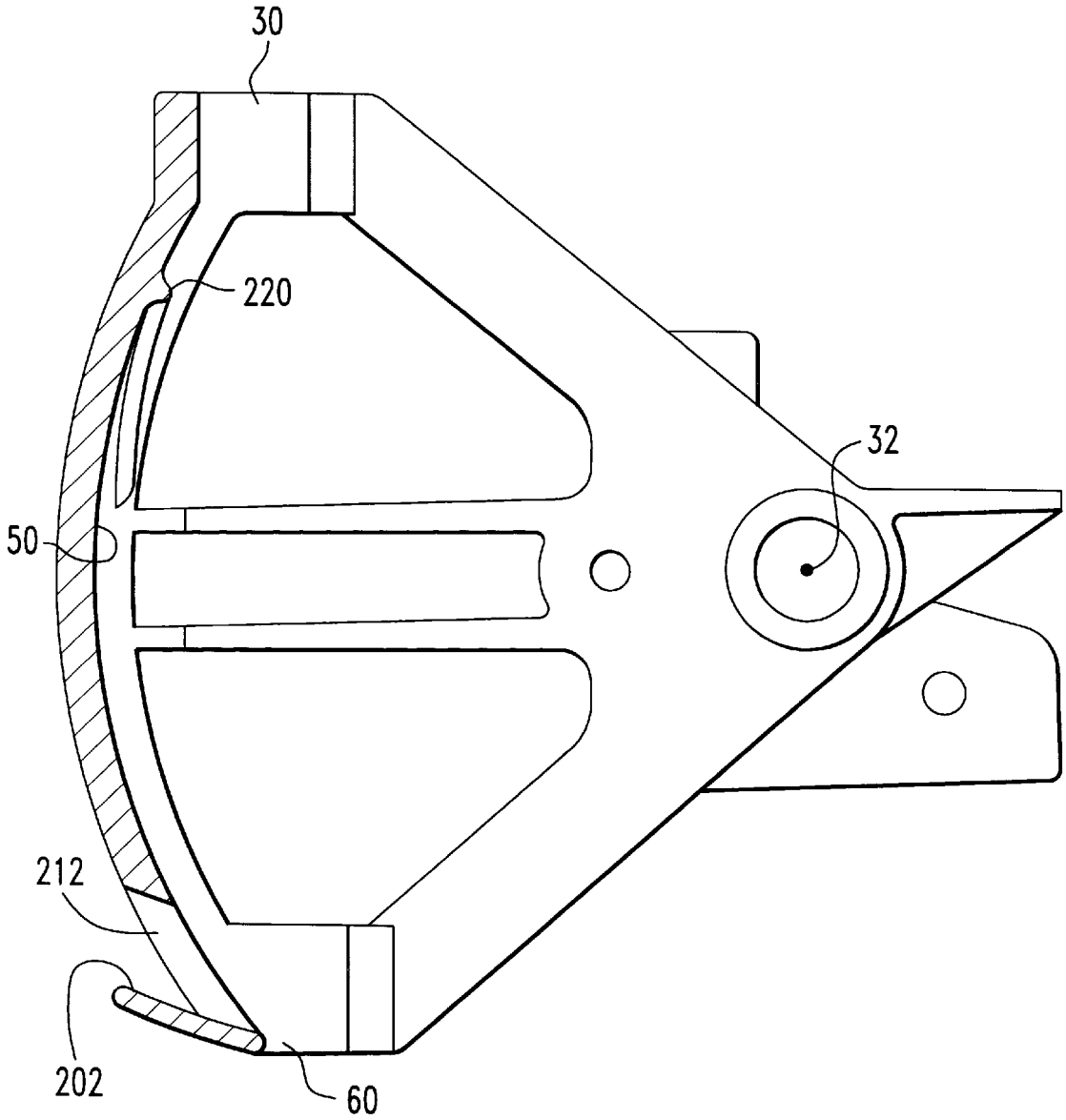
FIG. 7 is a section view of FIG. 6.

FIG. 7 is a sectional view of FIG. 6 taken through opening 212 and through a portion of the raised ridge 220. In FIG. 7, it can be seen that the gate 30 is rotatable about its axis 32 to move the leading edge 60 into the stream of water 12 as the gate 30 rotates in a counterclockwise direction about its axis 32. The axis 32 serves as the pivot point about which the gate 30 can move through a range of positions between the first position and the second position. As water, moving in a direction from right to left in FIG. 7, passes through opening 212, it strikes surface 202. The surface 202 acts in a manner generally similar to an air foil, and the force of the water against surface 202 creates a downward force on the gate 30. This downward force opposes the rejecting force $F_{REJECT}$ described above and helps the operator to move the gate 30 into the stream of water 12.

Also shown in FIG. 7 is the raised ridge 220 that provides a force that tends to move the gate 30 in a clockwise direction when the gate is more fully disposed within the stream of water. As the stream of water strikes the deflecting surface 50, it is deflected upward, downward, toward port, and toward starboard. The upward deflected water flows over the raised ridge 220 and exerts an upward force on the gate 30 which creates a clockwise moment about the pivot point at the axis 32. This force created by the raised ridge 220 partially counteracts the retaining force $F_{RETAIN}$ described above.

Figure 8:
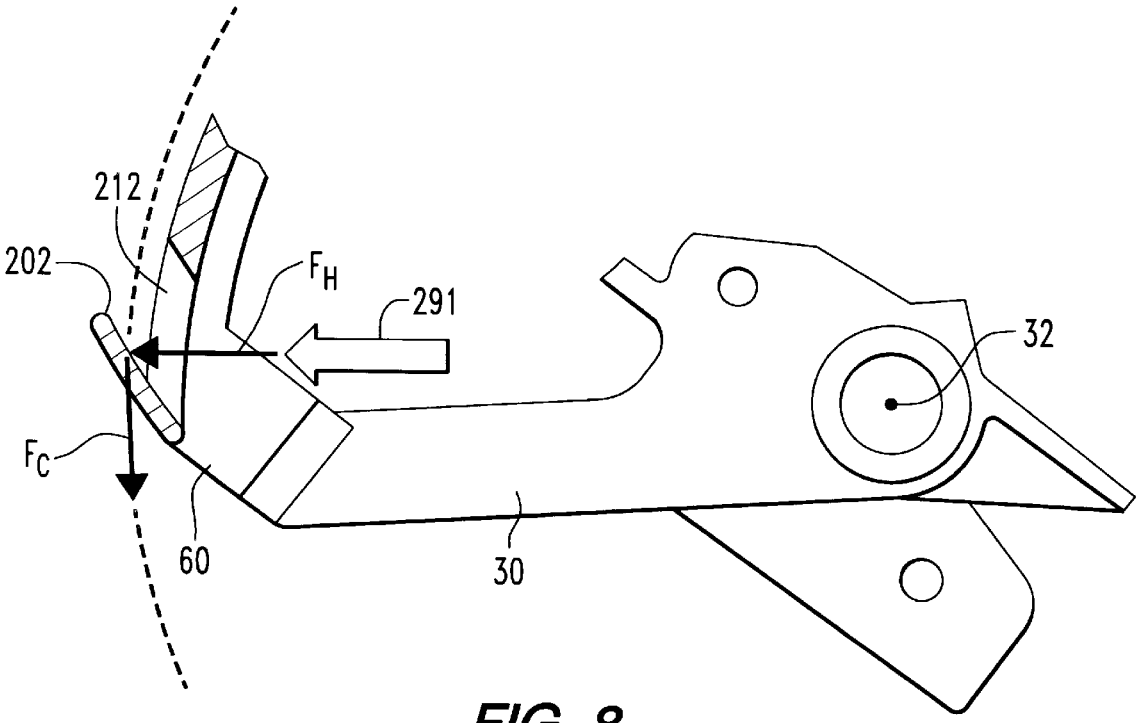
FIG. 8 is a partial view of FIG. 7.

FIG. 8 is a partial view of FIG. 7 showing the opening 212 and the surface 202. Arrow 291 represents the direction of the path of water flowing within the stream of water 12. This stream of water exerts a force $F_H$ on surface 202 as it strikes the surface and moves through opening 212. Because of the angle of surface 202 to the direction of the waterflow 291, a component $F_C$ of the force is provided in a direction that exerts a moment on the gate 30 to urge it to rotate in a counterclockwise direction about its axis 32. As the leading edge 60 of the gate 30 moves into the stream of water 12, this force $F_C$ provides an assistance to the operator during the engagement of the brake. In other words, surface 202 provides a first hydrodynamic assist device which is moveable with the gate 30 and provides a force that results in a moment about the pivot point 32 to urge the gate in a counterclockwise direction. The force $F_C$ reduces the force that the operator must provide in order to engage the brake by exerting a force in an opposite direction to the rejecting force described above.

Figure 9:
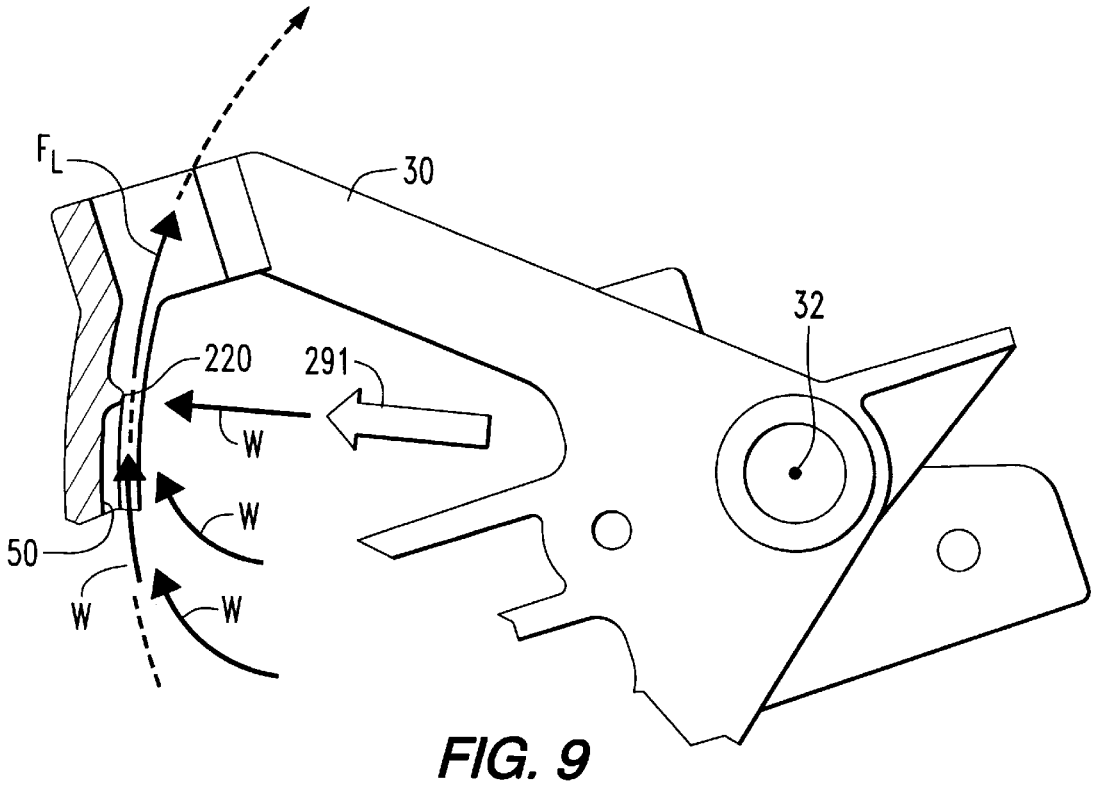
FIG. 9 is a partial view of FIG. 7.

FIG. 9 is a portion of the gate 30 illustrated in FIG. 7. Arrow 291 shows the basic direction of the stream of water 12 as it flows from the nozzle toward the deflecting surface 50. Arrows W in FIG. 9 represent the direction of flow of a portion of the deflected water as it strikes the deflecting surface 50. A portion of this water is deflected upward and over the raised ridge 220. The force of the water passing over the raised ridge 220 exerts a force $F_L$ that tends to urge the gate 30 to rotate in a clockwise direction about the pivot at the axis 32. When the deflecting surface 50 is disposed within the stream of water, as in the second position in the gate 30, force $F_L$ counteracts the retaining force $F_{RETAIN}$ described above. This force assists the operator in disengaging the brake by forcing the gate 30 out of the stream of water.

In order to understand the beneficial effects of the two hydrodynamic assist devices of the present invention, it is necessary to appreciate that the first hydrodynamic assist device provided by surface 220 begins to assist the operator as the leading edge 60 moves into the stream of water 12. This assisting force opposes the rejecting force $F_{REJECT}$ during the initial insertion of the gate 30 into the stream of water as the gate moves from the first position toward the neutral position where the rejecting force is significantly reduced. Then, after the gate 30 is in the second position within the stream of water and the operator wishes to disengage the brake, the second hydrodynamic assist device provided by the raised ridge 220 is able to provide its maximum help in counteracting the retaining force $F_{RETAIN}$ described above. The combination of these two hydrodynamic assist devices makes it easier for an operator to engage and disengage the brake mechanism than would otherwise be possible without them.

Figure 10:
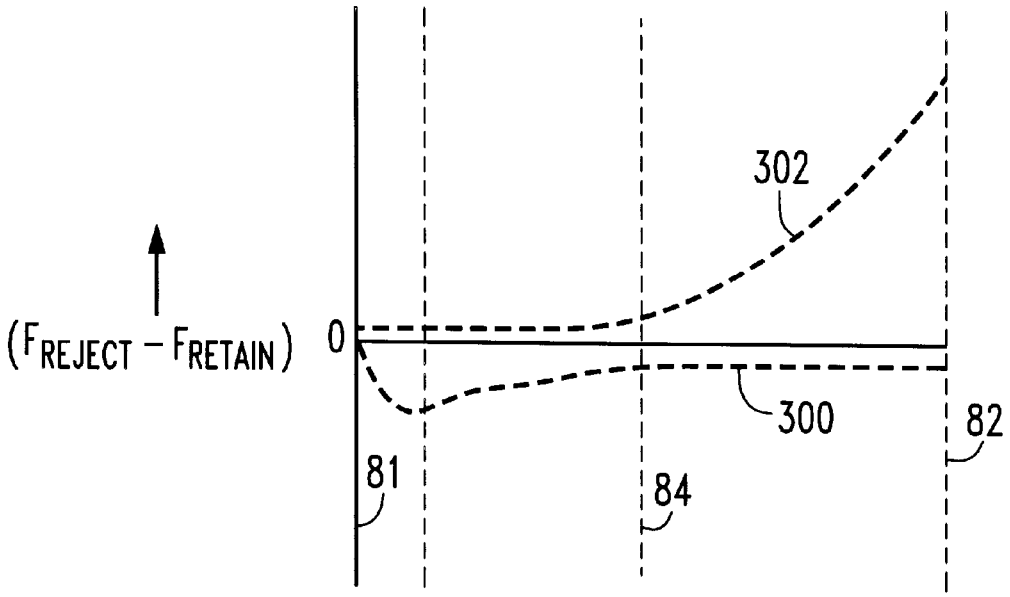
FIG. 10 shows the force profiles provided by two different types of hydrodynamic assist devices made in accordance with the present invention.

FIG. 10 is a graphical representation of the two forces provided by the two hydrodynamic assist devices of the present invention. Dashed line 300 shows the force $F_C$ described above in conjunction with FIG. 8 as the gate moves from the first position 81 to the second position 82. It can be seen that the force provided by surface 202 is at its maximum, in an opposing direction to the rejecting force, soon after the leading edge 60 of the gate 30 moves into the stream of water 12. The force $F_C$ provided by the surface 202 then gradually decreases and remains relatively low as the gate 30 moves between the neutral position 84 and the second position 82. The force $F_L$ provided by the raised ridge 220 and represented by dashed line 302 in FIG. 10 begins at a relatively low magnitude and remains low during most of the travel from the first position 81 to the neutral position 84. However, as the gate 30 moves fully into the stream of water 12, the force provided by the raised ridge 220 increases dramatically until the gate 30 reaches its final location in the second position 82.

Figure 11:
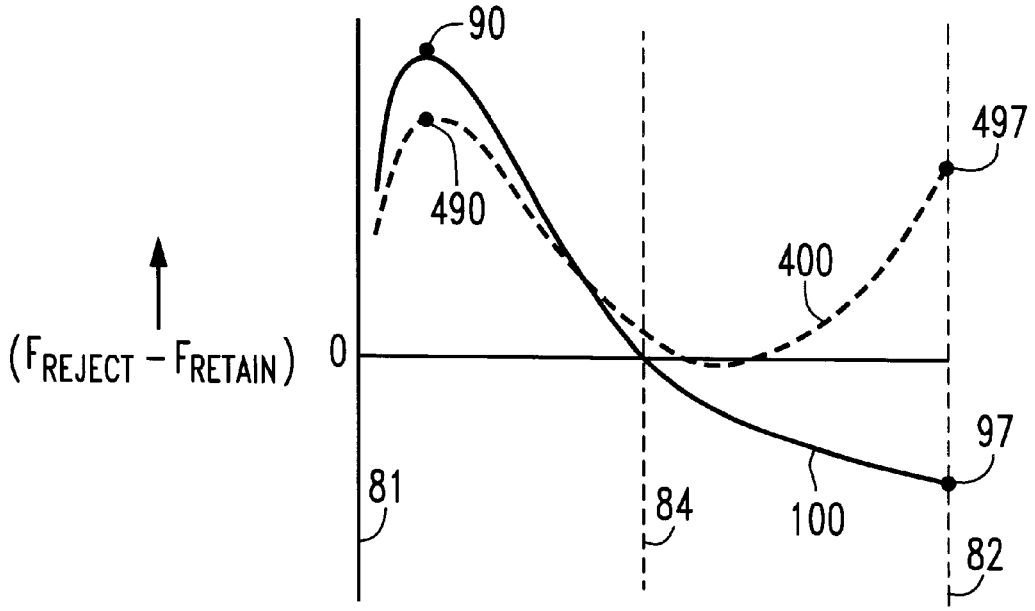
FIG. 11 shows the force profile of FIG. 4 and the force profile resulting from the addition of the two hydrodynamic assist devices of the present invention.

FIG. 11 shows the original graphical representation 100 of the force profile on the gate 30 which was discussed above in conjunction with FIG. 4. It also shows a dashed line 400 that represents the resulting profile of the force on the gate 30 when forces $F_C$ and $F_L$ are added to the original profile 100. As can be seen, the maximum rejecting force at point 90 is reduced to a decreased magnitude at point 490. The maximum retaining force at point 97, when the gate 30 is in its second position 82, has been completely overcome and converted to a rejecting force at point 497. The entire range of movement of the gate 30 now results in a manageable net rejecting force as represented by dashed line 400 in FIG. 11.

It should be understood that either of the two hydrodynamic assist devices could possibly be used alone without the other device. In other words, a gate could be provided with holes, 211 and 212, that have surfaces, 201 and 202, in order to overcome the rejecting force as described above. Alternatively, a gate 30 could be provided with the raised ridge 220, but not the openings 211 and 212. It has been found, however, that a combination of first and second hydrodynamic assist devices allow the gate 30 to be modified to more easily engage the gate 30 and disengage it. Naturally, it should be understood that the precise number of openings, 211 and 212, for the first hydrodynamic assist device or the size of the raised ridge 220 for the second hydrodynamic assist device will vary from one application to another. Also, the forces which combined to convert the force profile 100 in FIG. 11 to the force profile 400 in FIG. 11 resulted from a combination of both the first and second hydrodynamic assist devices.

Figure 12:
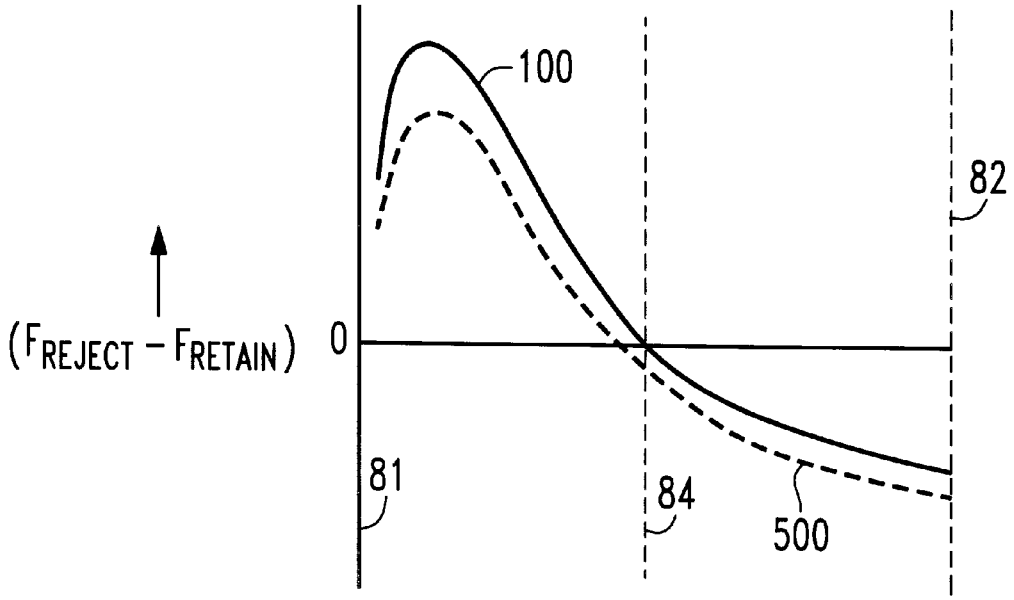
FIG. 12 shows the force profile of FIG. 4 and the force profile after being modified by the addition of one of the hydrodynamic assist devices of the present invention.

FIG. 12 shows the force profile 100 accompanied by a modified force profile 500 that resulted from the inclusion of openings, such as 211 and 212, in the leading edge 60 of the gate but without the raised ridge 220. As can be seen in FIG. 12, this results in a general reduction of the magnitudes of the resultant forces from the combination of the rejecting and retaining forces. In other words, the force profile 300 in FIG. 10 added to the force profile 100 in FIG. 12 results in the force profile 500 in FIG. 12.

Figure 13:
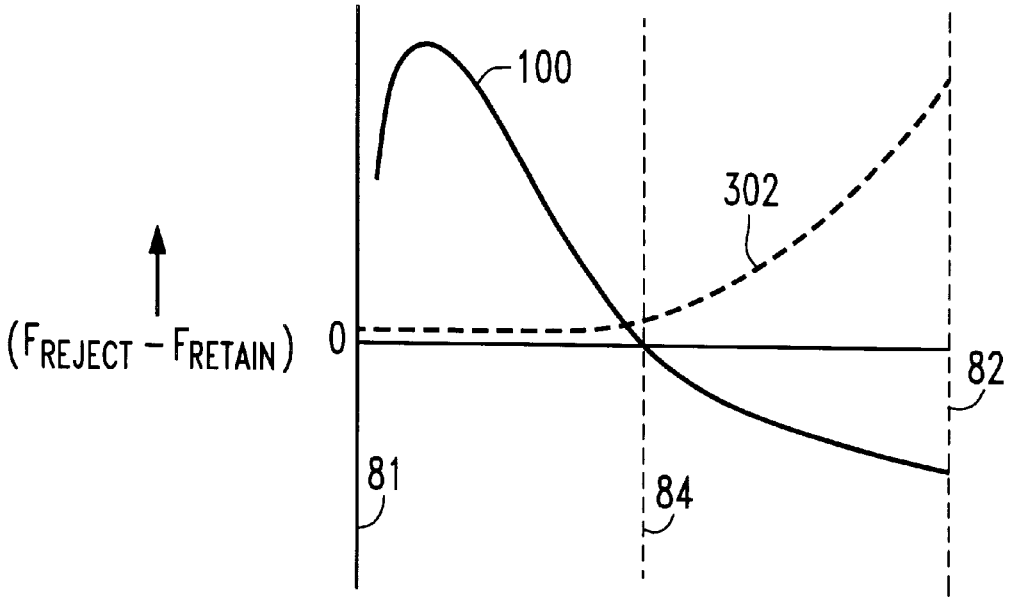
FIG. 13 shows the force profile of FIG. 4 and the force profile provided by one of the hydrodynamic assist devices of the present invention.

FIG. 13 shows a comparison of the force profile 100 of a standard gate, without the present invention incorporated, in comparison to the force profile 302 of the raised ridge 220 as described above in conjunction with FIG. 10. Although profile 302 is not a precise opposite to that of profile 100, the rejecting force provided by the raised ridge 220 achieves its maximum at the precise positions where it provides the greatest assistance to the operator in overcoming the retaining force on the gate 30 caused by the stream of water 12.

Figure 14:
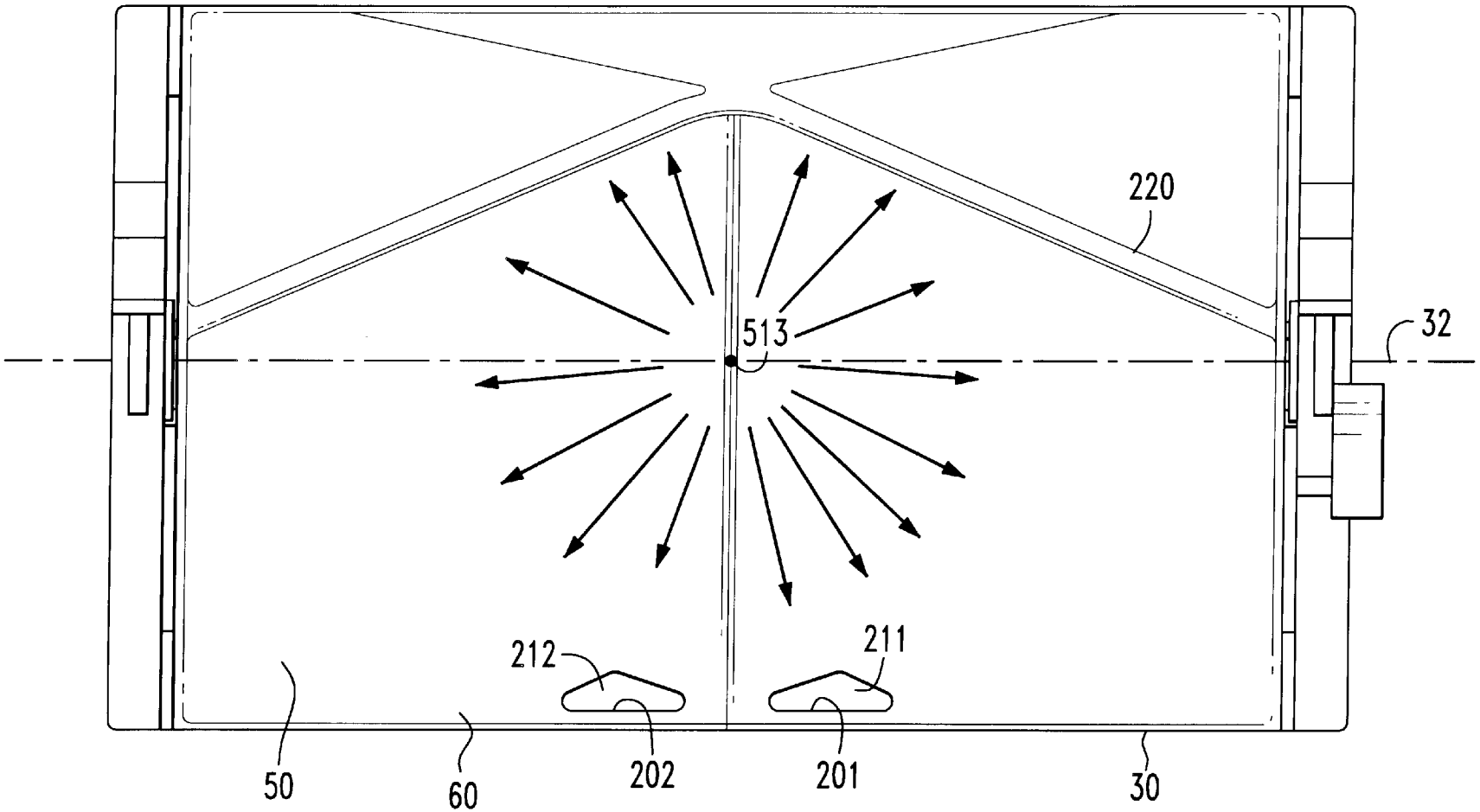
FIG. 14 shows a gate viewed in the direction from a nozzel.

FIG. 14 shows the gate 30 viewed from the direction of the nozzle. The deflecting surface 50 is the surface that the water strikes as it is emitted by the nozzle. The arrows in FIG. 14 schematically represent the direction in which the water is deflected after the stream of water 12 strikes the deflecting surface 50 at a region generally symmetrical about point 513. As shown in FIG. 14, the water is deflected in all directions along the deflecting surface 50. In order to more efficiently use the force of the deflected water for the purposes described above in conjunction with the raised ridge 220, the raised ridge is formed in the shape of a chevron or an inverted V-shape in a preferred embodiment of the present invention. The chevron shape allows the raised ridge 220 to be struck by more of the deflected water than would be possible if the raised ridge 220 merely extended across the deflecting surface 50 of the gate 30 in a horizontal direction in FIG. 14. For example, water that is deflected from point 513 in a direction which is less than 45 degrees from the axis 32 in an upward direction might not strike the raised ridge 220 if it was straight and horizontal. With a chevron configuration, a greater volume of water can be expected to strike the raised ridge 220 and provide an upward component of force which assists the operator of a watercraft in disengaging the brake.

The cross-sectional shape of the raised ridge 220 can vary, depending on the application of the present invention. In one particular application, the ridge was created by attaching a wire or thin rod which has a diameter of approximately 0.100 inches. The attached wire provided the necessary raised ridge to create the upward force on the gate 30 in response to the deflected water flowing over it.

By empirically determining the appropriate number of holes to provide the surfaces which assist the operator in engaging the brake and by selecting the appropriate size of the raised ridge 220 to assist the operator in disengaging the brake, a braking mechanism can be provided which can be actuated with the fingers of an operator on a hand lever without the need for the operator to release the grip on the handlebars. Unlike prior art braking systems which require the operator to reach down to the side of the hull to engage the reverse gate, the present invention provides for a braking system for a watercraft that is very similar to the braking system for a motorcycle and which can be actuated with finger pressure on a lever attached to the handlebars near the handgrips. From the description above, it can be seen that the number of holes used to provide the surfaces which oppose the rejecting force and the size of the raised ridge which provides the opposing force to counteract the retaining force can be modified and combined together in order to shape an appropriate force profile that is suitable for any particular brake application in conjunction with the watercraft. Although the present invention has been described with particular detail and illustrated with significant specificity to describe certain particularly preferred embodiments, it should be understood that alternative embodiments of the present invention are also within its scope.

I claim:

1. A control mechanism for a jet propelled watercraft, comprising:

a nozzle attached to said watercraft, said nozzle conducting a stream of water rearwardly from said watercraft to propel said watercraft;

a gate rotatably attached to said watercraft and movable about a pivot point through a range of positions from a first position which is essentially out of said stream of water to a second position which is essentially completely within said stream of water in order to provide a braking effect on said watercraft; and a first hydrodynamic assist device which is movable with said gate, said first hydrodynamic assist device providing a first force which results in a first moment about said pivot point to urge said gate in a first direction, said first hydrodynamic assist device comprising a surface which, when moved into said stream of water, creates said first force which urges said gate toward said second position, said surface of said first hydrodynamic assist device being formed by an opening through said gate near an edge of said gate which initially enters said stream of water when said gate is moved from said first position to said second position.

2. The control mechanism of claim 1, wherein:

said first direction is toward said second position to provide said braking effect on said watercraft.

3. The control mechanism of claim 1, further comprising:

a second hydrodynamic assist device which is movable with said gate, said second hydrodynamic assist device providing a second force which results in a second moment about said pivot point to urge said gate in a second direction.

4. The control mechanism of claim 3, wherein:

said second hydrodynamic assist device comprises a raised ridge which, when moved into said stream of water, creates said second force which urges said gate toward said first position.

5. The control mechanism of claim 4, wherein:

said raised ridge is formed on said gate at a location which is contacted by said stream of water when said gate is in said second position.

6. The control mechanism of claim 5, wherein:

said raised ridge is V-shaped.

7. The control mechanism of claim 3, wherein:

said second direction is toward said first position which is essentially out of said stream of water and said first direction is toward said second position which is essentially completely within said stream of water in order to provide a braking effect on said watercraft.

8. The control mechanism of claim 3, wherein:

said first force provides assistance when an operator of said watercraft is engaging said gate to act as a brake and said second force provides assistance when said operator of said watercraft is disengaging said gate.

9. The control mechanism of claim 1, wherein:

said gate is a hand operated lever attached to a handle bar of said watercraft and operable by the fingers of an operator of said watercraft while maintaining hand contact with said handle bar.

10. A control mechanism for a jet propelled watercraft, comprising:

a nozzle attached to said watercraft, said nozzle conducting a stream of water rearwardly from said watercraft to propel said watercraft;

a gate rotatably attached to said watercraft and movable about a pivot point through a range of positions from a first position which is essentially out of said stream of water to a second position which is essentially completely within said stream of water in order to provide a braking effect on said watercraft;

a first hydrodynamic assist device which is movable with said gate, said first hydrodynamic assist device providing a first force which results in a first moment about said pivot point to urge said gate in a first direction; and a second hydrodynamic assist device which is movable with said gate, said second hydrodynamic assist device providing a second force which results in a second moment about said pivot point to urge said gate in a second direction.

11. The control mechanism of claim 10, wherein:

said second direction is toward said first position which is essentially out of said stream of water and said first direction is toward said second position which is essentially completely within said stream of water in order to provide a braking effect on said watercraft.

12. The control mechanism of claim 10, wherein:

said first hydrodynamic assist device comprises at least one surface of an opening through said gate that acts to produce said first force when said surface is disposed within said stream of water; and said second hydrodynamic assist device comprises a raised ridge that produces said second force when said stream of water passes over said raised ridge.

13. The control mechanism of claim 10, wherein:

said first force provides assistance when an operator of said watercraft is engaging said gate to act as a brake and said second force provides assistance when said operator of said watercraft is disengaging said gate.

14. The control mechanism of claim 10, wherein:

said gate is a hand operated lever attached to a handle bar of said watercraft and operable by the fingers of an operator of said watercraft while maintaining hand contact with said handle bar.

15. A control mechanism for a jet propelled watercraft, comprising:

a nozzle attached to said watercraft, said nozzle conducting a stream of water rearwardly from said watercraft to propel said watercraft;

a gate rotatably attached to said watercraft and movable about a pivot point through a range of positions from a first position which is essentially out of said stream of water to a second position which is essentially completely within said stream of water in order to provide a braking effect on said watercraft;

a first hydrodynamic assist device which is movable with said gate, said first hydrodynamic assist device providing a first force which results in a first moment about said pivot point to urge said gate in a first direction; and a second hydrodynamic assist device which is movable with said gate, said second hydrodynamic assist device providing a second force which results in a second moment about said pivot point to urge said gate in a second direction, said second direction being toward said first position which is essentially out of said stream of water and said first direction being toward said second position which is essentially completely within said stream of water in order to provide a braking effect on said watercraft, said first hydrodynamic assist device comprising at least one surface of an opening through said gate that acts to produce said first force when said surface is disposed within said stream of water, said second hydrodynamic assist device comprising a raised ridge that produces said second force when said stream of water passes over said raised ridge, said first force providing assistance when an operator of said watercraft is engaging said gate to act as a brake and said second force providing assistance when said operator of said watercraft is disengaging said gate.

16. The control mechanism of claim 15, wherein:

said gate is a hand operated lever attached to a handle bar of said watercraft and operable by the fingers of an operator of said watercraft while maintaining hand contact with said handle bar.

* * * * *